US007451988B1

(12) United States Patent
Kershner

(10) Patent No.: US 7,451,988 B1
(45) Date of Patent: Nov. 18, 2008

(54) CARD DRIVEN WORD GUESSING GAME

(76) Inventor: Kristina Kershner, 127 Eastgate Dr., Suite 212-G, Los Alamos, NM (US) 87544

( * ) Notice: Subject to any disclaimer, the term of this patent is extended or adjusted under 35 U.S.C. 154(b) by 208 days.

(21) Appl. No.: 11/314,265

(22) Filed: Dec. 20, 2005

Related U.S. Application Data

(60) Provisional application No. 60/638,189, filed on Dec. 20, 2004.

(51) Int. Cl.
*A63F 9/00* (2006.01)

(52) U.S. Cl. ..... 273/299; 273/429

(58) Field of Classification Search ..... 273/292, 273/429, 430, 431, 432, 274, 299, 302, 308
See application file for complete search history.

(56) References Cited

U.S. PATENT DOCUMENTS 2,380,106 A * 7/1945 Jenkins ..... 273/240
3,734,510 A * 5/1973 Breslow ..... 273/292
4,123,051 A * 10/1978 Tsacoyannis ..... 273/429
4,222,561 A * 9/1980 Whitten ..... 273/429
4,635,939 A * 1/1987 Makow ..... 273/296
4,911,452 A * 3/1990 Marchese, Jr. ..... 273/240
5,211,402 A * 5/1993 Ferguson et al. ..... 273/249
5,454,569 A * 10/1995 Walker ..... 273/236
6,139,016 A * 10/2000 Plato ..... 273/242
6,279,909 B1 * 8/2001 Alexander et al. ..... 273/249
6,422,562 B1 * 7/2002 Daniel ..... 273/272
6,719,290 B1 * 4/2004 Kershner ..... 273/272
6,966,556 B1 * 11/2005 Culley et al. ..... 273/272
7,287,755 B1 * 10/2007 Kershner ..... 273/272

* cited by examiner

*Primary Examiner*—William M Pierce

(57) ABSTRACT

A game and method for playing wherein a player attempts to correctly guess another player's response to a cue, wherein the response is limited to only those which contain one or more words that begin with a predetermined letter of the alphabet.

19 Claims, 2 Drawing Sheets

CARD DRIVEN WORD GUESSING GAME

CROSS-REFERENCE TO RELATED APPLICATIONS

This application claims priority to and the benefit of the filing of U.S. Provisional Patent Application Ser. No. 60/638,189, entitled "Card Driven Word Guessing Game", filed on Dec. 20, 2004, and the specification thereof is incorporated herein by reference.

COPYRIGHTED MATERIAL

© 2000-2004 GnuGames, Inc. A portion of the disclosure of this patent document and of the provisional application, listed above, to which this application claims priority, contains material that is subject to copyright protection. The owner has no objection to the facsimile reproduction by anyone of the patent document or the patent disclosure, as it appears in the Patent and Trademark Office patent file or records, but otherwise reserves all copyrights whatsoever.

BACKGROUND OF THE INVENTION

1. Field of the Invention (Technical Field)

The present invention relates to a game for entertaining a plurality of people. Particularly, the present invention relates to a game wherein a letter of the alphabet is selected and wherein a question is presented which is preferably answered at least partly by one or more words which begin with the selected letter of the alphabet.

2. Description of Related Art

Methods and apparatuses for entertaining groups of persons are well documented and have been known throughout the ages. Due to the limited amount of financial resources of most persons, entertaining games designed for groups of persons which can be provided without expensive equipment, such as computer and television games, are particularly desirable.

Scattegories® is a game in which players quickly answer several questions with respect to a commonly selected letter of the alphabet. In that game, however, players are not divided into competing teams. Also, in that game, players all answer several questions rather than just one. Finally, the objective of that game is to obtain answers to similar questions which are unique and do not match any other player's answers. While the prior art games may be entertaining, most of the known games enable a person to learn very little or nothing about the way in which members of the competing party think.

There is thus a need for a method and game which is not only entertaining, but also enables groups of players to glean insight into the way in which the members of the opposing party think and which can be provided inexpensively and without costly equipment.

BRIEF SUMMARY OF THE INVENTION

The present invention relates to a method for playing a game for two or more players having the steps of assigning one or more players to a first group, assigning one or more other players to a second group, providing a hint card to at least one player, providing a cue card to at least one player, a first player generating a response based at least partly on the hint card and the cue card, and other players attempting to correctly guess the first player's response.

In the method the step of assigning one or more players to a first group can comprise assigning one or more players to a first group based on the player's gender and the step of assigning one or more players to a second group can comprise assigning one or more players to a second group based on the player's gender. Optionally, the steps of providing a hint card and/or a cue card can also include a player selecting a single card for each from a deck of cards.

Additionally, in the method, the step of providing a cue card to at least one player can have the step of providing a cue card to the same player to whom a hint card is also provided. The step of other players attempting to correctly guess the first player's response can comprise members of the first player's team attempting to correctly guess the first player's response. The method can also have the step of starting a timer and the timer can optionally be started after both of the providing steps have been performed. The timer can include any device, apparatus, method or structure, including but not limited to a sand timer, an electronic timer, a mechanical timer, and combinations thereof.

The method can also have the step of providing one or more apparatuses with which a player may at least temporarily preserve a response. The apparatuses can include but are not limited to one or more pieces of paper and one or more writing utensils. In another embodiment, the method can include the step of announcing the number of words in the response.

The present invention also relates to a method for entertaining two or more persons having the steps of providing instructions to at least one of the persons, providing one or more hint cards, and providing one or more cue cards, wherein a first player obtains a hint in response to a hint card, the first player obtains a cue in response to a cue card and wherein a the first player generates a response based on the hint and cue. The method can also relate to entertaining four or more persons. If the method relates to four or more persons, the method can also have the step of assigning at least two of the players to one group and assigning the remaining players to another group. The method can also have the step of players attempting to correctly guess the first player's response and the players attempting to correctly guess the first player's response can be other players also assigned to the first player's group attempting to correctly guess the first player's response.

The method can also have the step of the first player announcing the number of words in the first player's response and/or the step of the step of the first player at least temporarily recording the response.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1A:
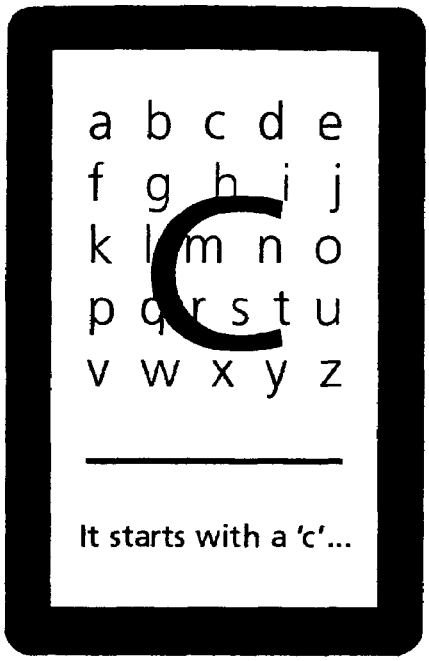
FIGS. 1A and 1B are drawings illustrating an embodiment for hint cards for a couple of letters of the alphabet in accordance with a preferred embodiment of the present invention.
Figure 1B:
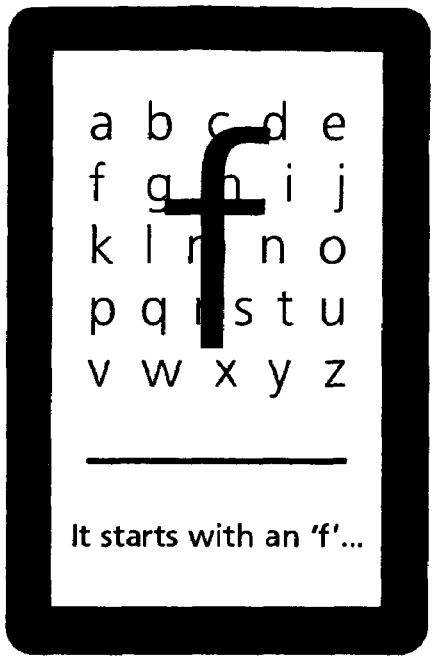
Figure 2:
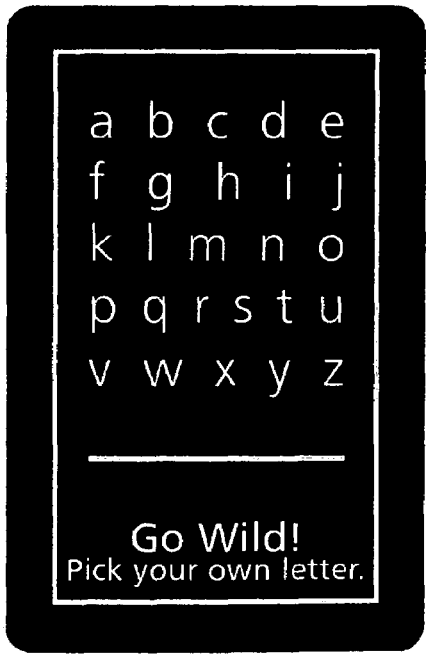
FIG. 2 is a drawing illustrating an embodiment of a wild hint card in accordance with a preferred embodiment of the present invention.

The term "hint card" as used throughout the specification and claims is used for the sake of simplicity and is intended to include any and all apparatuses, structures, elements, materials, methods, and/or combinations thereof which provide a manner by which a person can obtain and/or select a letter of the alphabet. The phrase "It starts with a(n)" preferably precedes the letter of the alphabet. As such, the term "hint card" is intended to include, but not limited to: a user unassistedly generating a letter at random, a spinner with letters of the alphabet labeled thereon which is spun with respect to a pointer, an electronic apparatus which randomly or non-randomly provides a letter of the alphabet, a multi-sided object depicting a letter of the alphabet on each side and which can be tossed by a user, and the like. The term "hint card", however, more preferably relates to a member of a group of cards which are provided wherein a different letter of the alphabet is listed on one side of each card. The hint card of the present invention is most preferably a plurality of cards, each having a different letter of the alphabet disposed on a single side thereof, for example, as depicted in FIGS. 1A and 1B. In addition to the foregoing, hint cards of the present invention can also optionally contain one or more cards which encourages a user to select any letter of the alphabet, for example, as depicted in FIG. 2.

Figure 3A:
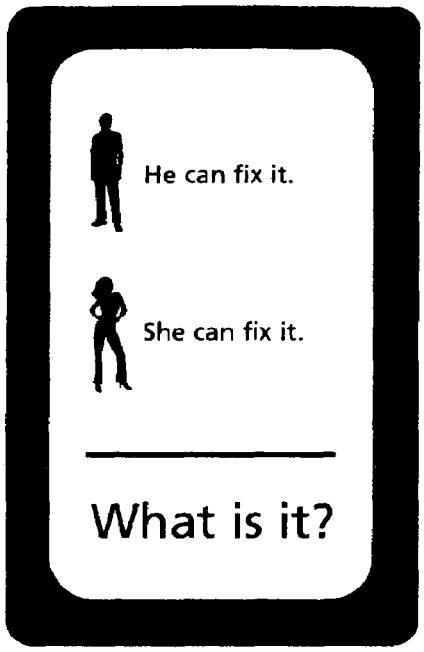
FIGS. 3A and 3B are drawings illustrating an embodiment of cue cards with a couple of pre-recorded cues in accordance with a preferred embodiment of the present invention.
Figure 3B:
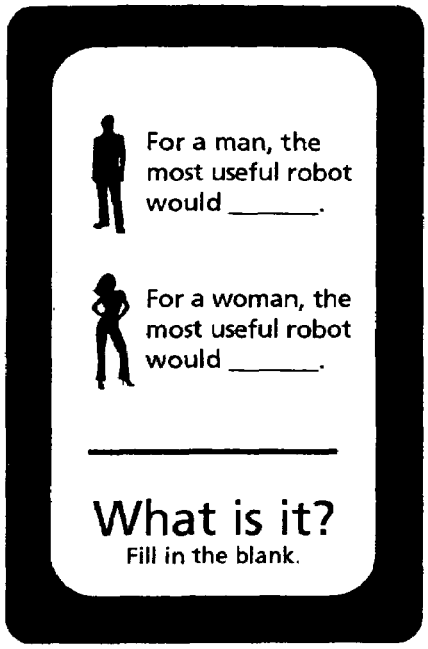
Figure 4:
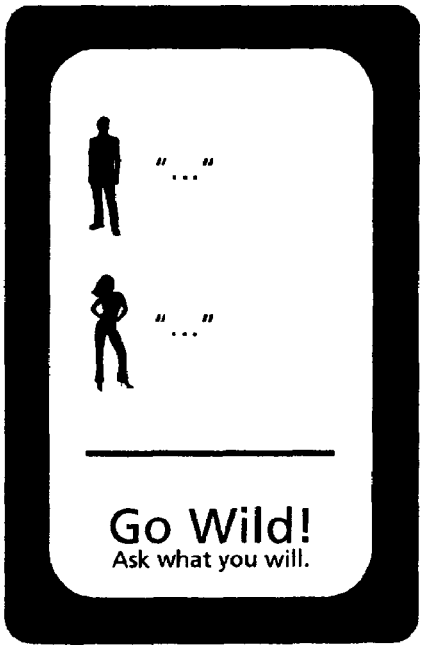
FIG. 4 is a drawing illustrating an embodiment of wild cue card in accordance with a preferred embodiment of the present invention.

The term "cue card" as used throughout the specification and claims is used for the sake of simplicity and is intended to include any and all apparatuses, structures, elements, materials, methods, and/or combinations thereof which provide a manner by which a person can obtain a prerecorded cue. As such, the term "cue card" is intended to include, but not limited to: a user unassistedly generating a cue, an electronic apparatus which can display or otherwise inform a user as to a cue, one or more writings which contain one or more cues. The term "cue card", however, preferably relates to a member of a group of cards which are provided wherein two written statements are disposed on a single side of each card. The term "cue card" more preferably relates to a member of a group of cards which are provided wherein a written statement, directed toward one or more groups of players are recorded on a single side of each card, for example, as depicted in FIGS. 3A and 3B. In addition to the foregoing, cue cards of the present invention can also optionally contain one or more cards which encourage a user to create a cue, for example, as depicted in FIG. 4.

The present invention is directed to a game and method of playing. The participants are preferably divided into two teams. Most preferably, the participants are divided into two teams based upon each player's gender.

The following text concerning the objective of the game is preferably provided to the players: "Guess the answers given by your teammates to mischievous and playful questions about the opposite sex, and score!"

The following setup is preferred: Divide the players into two teams. Preferably, the Pink Team for women and the Blue Team for men. If, however, all the players are all-female, for example at a bridal shower, half the women preferably pretend to be men and think like men. If, on the other hand, all the players are all-male, for example, at a bachelor party, half of the men preferably pretend to be women and think like women. Each team is then given an apparatus for recording data, such as a pen and paper, a laptop with a data processor, a palm pilot, or the like. The decks of Hint and Cue cards are then placed face down between the two teams.

The following steps are preferably given to and followed by the two or more players and most preferably, cards similar to those depicted in FIGS. 1A-4 are also provided to the players in reference to the following:

"1. The Pink Team goes first. A Pink Team player stands in front of the group with a pad and pencil. (This position rotates among team members each round.)

2. A Blue Team player draws a Hint card and reads it out loud. (If a Wild card is drawn, he can choose any letter of the alphabet he wishes.)

3. Next, the Blue Team player draws a Cue card and reads the [male symbol] statement out loud, ending with the question, "What is it?" (If a Wild card is drawn, the Blue Team player must make up a statement, ending with the question, "What is it?" Both the Hint and Cue cards are then laid face-up so everyone can see them.

4. Immediately, a Blue Team player starts the 30-second timer.

5. As quickly as possible, the Pink Team player secretly writes down her answer to the question, "What is it?" (See sample responses.) The answer can be either one or two words. At least one of these words must start with the letter on the Hint card. Any words are acceptable, even names.

6. After the Pink Team player has written down her answer, she says "One word," or "Two words." This indicates that she is finished and lets her teammates know how many words are in her answer.

7. Before time runs out, her teammates try to guess what she wrote by shouting out answer. She cannot make any gestures that would help her teammates guess her answer. The Blue Team alerts the Pink Team when time is up.

Hint: Your team has only 30 seconds to both write and guess the answer. Therefore, the longer it takes you to write down your answer, the less time your teammates have to guess.

8. If one of her teammates correctly guesses the written answer (the teammate must guess the exact word or words), her team scores and keeps the hint card. If they do not correctly guess the answer, the Blue Team gets 30 seconds to offer one guess (one guess for the whole team, not one guess per team member). If they guess correctly, they steal the Hint card. If they do not guess correctly, the Hint card is discarded into a discard pile (or the game box lid). The Cue card is returned to the bottom of the Cue deck.

9. Play then passes to the Blue Team. The Pink Team draws and reads cards for the Blue Team. (The Pink Team reads the [female symbol] statement on the Cue card).

10. Play continues until all Hint cards have been used. At the end, the team with the most Hint cards wins!"

In another embodiment, the foregoing rules are preferably given, however, rule 7 is preferably changed to read "Before time runs out, her teammates try to guess what she wrote by shouting out answers. The Blue Team alerts the Pink Team when time is up. Note: Gestures are allowed if all players agree before the game begins.

Hint: Your team has only 30 seconds to both write and guess the answer. Therefore, the longer it takes you to write down your answer, the less time your teammates have to guess."

An alternative embodiment of the present invention provides for a role reversal. In this embodiment, the blue team preferably read the [female symbol] statement (cue) and the Pink Team preferably read the [male symbol] statement (cue).

In another alternative embodiment, the same rules as that contained within 1-10 of the foregoing apply, except all players preferably shout out answers. In this embodiment, whichever team correctly guesses the answer, scores and optionally keeps the Hint card.

In yet another alternative embodiment, if only two players are present, one player is designated as the "Pink Player" and the other player is designated as the "Blue Player". In this embodiment, the Pink Player preferably reads a hint card and a cue card out loud. The Blue Player then preferably writes down that person's answer or otherwise preserves it, at least temporarily. The Pink Player then preferably attempts to guess the answer. In one embodiment, the pink player gets only a limited number of guesses. In another embodiment, if the pink player guesses correctly within the predetermined number of allotted guesses, that player gets a reward (of the player's choosing). Players take turns reading cards for each other, guessing answers, and giving and receiving rewards.

Although some embodiments of the foregoing specifically refer to dividing players up into groups based upon gender and to providing cue cards which contain symbols for men and/or women, desirable results can also be obtained by separating the players into groups based on attributes which are not related to gender, including attributes randomly selected. While the most preferred embodiment of the present invention provides cue cards with male and female figures depicted next to cues intended to be read by a team containing members of that gender, the cue cards of the present invention need not necessarily contain any such symbol. Desirable results can be obtained by placing another identifier next to each cue. Desirable results can further be obtained by providing no identifier for either or both cues on a card.

While the most preferred embodiment of the present invention provides a plurality of cues on a single cue card, desirable results are also produced when a single cue is provided on each cue card. In this alternative embodiment, cue cards are preferably created which are directed to or otherwise relate to a particular group of players. As such, in this embodiment, two or more groups of cue cards are preferably created.

It is important to note that while the most preferred embodiment of the present invention provides for players to be divided into competing groups, an alternative embodiment of the present invention also provides for a first player to be selected, either at random or in a predetermined order, and for a second player to be selected, either at random or in a predetermined order. In this embodiment, a first player obtains a letter from the hint card. The first player preferably announces this letter to the other players. The first player then preferably obtains a cue from a cue card. The first player then preferably announces this cue to the other players. After the hint and cue are announced, a timer is preferably started. While the length of the time span for the timer is not essential and although desirable results can be obtained at numerous other lengths of time, the timer is preferably about a thirty second timer. The second player then preferably determines a result based upon the hint and the cue. The second player then preferably preserves, at least temporarily, this result in a format which is determinable to other players, although the result is preferably not yet made available to the other players at this point. In one embodiment, the result is a single word in length. In an alternative embodiment, the result is two words in length. In another embodiment, the result can be a variable number of words in length. If the result can be a variable number of words in length, the second player then preferably announces the number of words for the length of the result. After announcing the number of words in the second player's result, or after the other players otherwise becoming aware that the second player has preserved the result, the remaining players, which can either be additional players that are not the first player, additional players and the first player, or the other players can be the first player, attempt to guess the preserved result before the timer runs out. In one embodiment, a successful guess by a player of the preserved response entitles that player to receive one or more points.

In a preferred embodiment of the present invention, the following is preferably provided: 104 cue cards (including two Wild cards), 28 Hint cards (including two Wild cards), one 30-second timer, two scratch pads, two pencils and this instruction booklet.

The following examples illustrate two of the possible combinations of hint cards and cue cards which are possible in accordance with the teachings of the present invention as well as a possible response which may be elicited by a player for that combination.

EXAMPLE 1

Hint Card: It states with a 'P' . . .
Cue Card He has one. She wants one.
What is it?
Response: "Plaything!"

EXAMPLE 2

Hint Card It starts with an 'L' . . .
Cue Card She controls it. He wants to. What is it?
Response: "His Life!"

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above and/or in the attachments, and of the corresponding application(s), are hereby incorporated by reference.

What is claimed is:

1. A method for playing a game for two or more players, the method comprising:

assigning one or more players to a first group;

assigning one or more other players to a second group;

providing a hint card to at least one player, the hint card designating a letter of the alphabet;

providing a cue card to at least one player;

a first player generating a response, the response comprising a letter designated by the hint card and the response based at least partly on the cue card; and other players attempting to correctly guess the first player's response.

2. The method of claim 1 wherein assigning one or more players to a first group comprises assigning one or more players to a first group based on the player's gender.

3. The method of claim 1 wherein assigning one or more players to a second group comprises assigning one or more players to a second group based on the player's gender.

4. The method of claim 1 wherein providing a hint card comprises a player selecting a single card from a deck of cards.

5. The method of claim 1 wherein providing a cue card comprises a player selecting a single card from a deck of cards.

6. The method of claim 1 wherein providing a cue card to at least one player comprises the step of providing a cue card to the same player to whom a hint card is also provided.

7. The method of claim 1 wherein other players attempting to correctly guess comprise members of the first player's team attempting to correctly guess the first player's response.

8. The method of claim 1 further comprising starting a timer.

9. The method of claim 8 wherein starting a timer comprises starting a timer after providing a hint card and providing a cue card.

10. The method of claim 8 wherein starting a timer comprises starting a timer selected from the list consisting of a sand timer, an electronic timer, a mechanical timer, and combinations thereof.

11. The method of claim 1 further comprising providing one or more apparatuses on which a player may record a response.

12. The method of claim 11 wherein the one or more apparatuses comprise one or more pieces of paper and one or more writing utensils.

13. The method of claim 1 further comprising announcing the number of words in the response.

14. A method for entertaining two or more persons comprising:

providing instructions to at least one of the persons;

providing one or more hint cards which designate a letter of the alphabet; and providing one or more cue cards;

wherein a first player obtains a hint in response to a hint card, the first player obtains a cue in response to a cue card, the first player generates a response containing the letter of the alphabet designated by the hint card and based on the cue, and players attempt to correctly guess the first player's response.

15. The method of claim 14 wherein the method relates to entertaining four or more persons.

16. The method of claim 15 further comprising assigning at least two of the players to one group and assigning the remaining players to another group.

17. The method of claim 14 wherein the step of players attempting to correctly guess the first player's response comprise other players also assigned to the first player's group attempting to correctly guess the first player's response.

18. The method of claim 14 further comprising the step of the first player announcing the number of words in the first player's response.

19. The method of claim 14 further comprising the step of the first player at least temporarily recording the response.

* * * * *